US009091153B2

(12) United States Patent
Yang et al.

(10) Patent No.: US 9,091,153 B2
(45) Date of Patent: Jul. 28, 2015

(54) WIRELESS TWO-WAY COMMUNICATION FOR DOWNHOLE TOOLS

(75) Inventors: Libo Yang, Katy, TX (US); Reza Taherian, Al-Khobar (SA); Dean M. Homan, Sugar Land, TX (US); Paul Wanjau, Missouri City, TX (US); David Rose, Sugar Land, TX (US); Onur Ozen, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 280 days.

(21) Appl. No.: 13/527,102

(22) Filed: Jun. 19, 2012

(65) Prior Publication Data

US 2013/0168081 A1 Jul. 4, 2013

Related U.S. Application Data

(60) Provisional application No. 61/581,292, filed on Dec. 29, 2011.

(51) Int. Cl.
*E21B 47/12* (2012.01)

(52) U.S. Cl.
CPC ..... *E21B 47/12* (2013.01); *E21B 47/122* (2013.01)

(58) Field of Classification Search
CPC ..... E21B 44/05; E21B 47/12
See application file for complete search history.

(56) References Cited

U.S. PATENT DOCUMENTS

| | | | | |
|---|---|---|---|---|
| 6,649,906 | B2 | 11/2003 | Adolph et al. | |
| 7,178,607 | B2 | 2/2007 | Mayes | |
| 7,347,261 | B2 | 3/2008 | Markel et al. | |
| 7,564,948 | B2 | 7/2009 | Wraight et al. | |
| 2006/0044155 | A1 | 3/2006 | Le Briere et al. | |
| 2010/0213942 | A1 | 8/2010 | Lazarev | |
| 2011/0248566 | A1 * | 10/2011 | Purkis | 307/40 |
| 2013/0238145 | A1 * | 9/2013 | Hammer et al. | 700/279 |

FOREIGN PATENT DOCUMENTS

| | | | |
|---|---|---|---|
| WO | 2008133633 | A1 | 11/2008 |
| WO | 2011056263 | A1 | 5/2011 |

* cited by examiner

*Primary Examiner* — William P Neuder
(74) *Attorney, Agent, or Firm* — Cathy Hewitt; Michael Dae

(57) ABSTRACT

Systems, methods, and devices for two-way communication with a downhole tool string are provided. In one example, a method may include placing a downhole tool string into a pressure riser of a well while at least one component of the downhole tool string is not activated. Thereafter, a wireless control signal may be issued through the pressure riser to the downhole tool to cause the downhole tool string to activate the component. The wireless control signal may involve an acoustic signal, an optical signal, and/or an electromagnetic signal such as electrical dipole coupling or magnetic dipole coupling.

18 Claims, 12 Drawing Sheets

WIRELESS TWO-WAY COMMUNICATION FOR DOWNHOLE TOOLS

CROSS-REFERENCE TO RELATED APPLICATIONS

The present disclosure claims the benefit of U.S. Provisional Application No. 61/581,292, titled "WIRELESS TWO-WAY COMMUNICATION FOR DOWNHOLE TOOLS" and filed Dec. 29, 2011, which is incorporated by reference herein in its entirety.

BACKGROUND

The present disclosure relates generally to downhole well-logging tools and, more particularly, to wireless communication for downhole well-logging tools.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A variety of downhole tools are used to obtain wellbore measurements. In general, downhole tools include sensors to measure the parameters of the rock formation surrounding the wellbore. Some downhole tools may obtain wellbore measurements by emitting radiation into the surrounding rock formation and detecting radiation that returns to the tool. These nuclear downhole tools may emit radiation using radioisotope sources or electronic nuclear radiation generators.

A downhole tool string may house one or more downhole tools. Typically, the downhole tool string includes a data storage device and/or a controller (often collectively referred to as a recorder). Communication with the downhole tool string via the data storage device and/or the controller may require an electrical connection to certain communication ports in the downhole tool string. The design of these electrical connectors may be prohibited by a variety of factors. Among other things, the mechanical constraints of the pressure housing of the downhole tool string may prohibit the use of these electrical connectors. Certain government regulations, such as the European ATEX (ATmospheres EXplosibles) regulations, may also proscribe the use of such electrical connectors at a producing wellsite.

Given these constraints on wired communication, certain wireless communication approaches have been attempted. Even conventional wireless communication approaches, however, may not be effective in many common well-logging circumstances. In one approach, a sonic device such as a buzzer may be used to relay information between the downhole tool string and a human operator. The buzzer may communicate with the tool operator with a series of high-volume beeps of selected timing and duration. Though effective under some circumstances, the sonic buzzer may be difficult to hear on a typical rig floor, since an operating rig may have a number of very high-volume sound sources. Not only does external noise interfere, but the sound penetration through the typical downhole tool string housing may also be limited. Furthermore, the range of information that can be transferred through the sonic device or buzzer is minimal due to the inconsistency of sound communications in such an uncontrolled environment. Finally, the transmission of information is unidirectional in this approach—from the sound buzzer in the downhole tool string to the human operator—meaning this manner of communication cannot be used to reprogram the downhole tool string once it has been lowered into the well.

In another wireless communication technique, an optical communication port in the housing downhole tool string may communicate by sending and receiving light signals. Optical communication in this way may depend on a direct, unimpeded view of the optical communication port. Thus, communication may be effective when the downhole tool string is in plain view of an external optical transceiver. When the downhole tool string is deployed through a pressure riser of a well, however, conventional wireless optical communication may be precluded.

SUMMARY

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

The present disclosure relates to systems, methods, and devices for two-way communication with a downhole tool string. In one example, a method may include placing a downhole tool string into a pressure riser of a well while at least one component of the downhole tool string is not activated. Thereafter, a wireless control signal may be issued through the pressure riser to the downhole tool to cause the downhole tool string to activate the component. The wireless control signal may involve an acoustic signal, an optical signal, and/or an electromagnetic signal such as electrical dipole coupling or magnetic dipole coupling.

In another example, a system may involve a downhole tool string with a first wireless communication device and a logging unit with a communication link to a second wireless communication device. The second wireless communication device may be disposed on and/or embedded in a stuffing box and/or a pressure riser. The logging unit may also convey the downhole tool string through the stuffing box into the pressure riser of the well. Using the first wireless communication device and the second wireless communication device, the logging unit and the downhole tool string may intercommunicate while the downhole tool string is located in the pressure riser.

In another example, a downhole tool string may include a first magnetic dipole antenna to transmit and/or receive wireless signals via magnetic dipole coupling with a second magnetic dipole antenna external to the downhole tool string.

In another example, a method may involve raising a downhole tool string out of a borehole of a well and into a pressure riser of the well while a downhole tool of the downhole tool string is in a first operational state. While the downhole tool string is in the pressure riser, a wireless control signal may be issued to the downhole tool string to cause the downhole tool to exit the first operational state and enter a second operational state.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
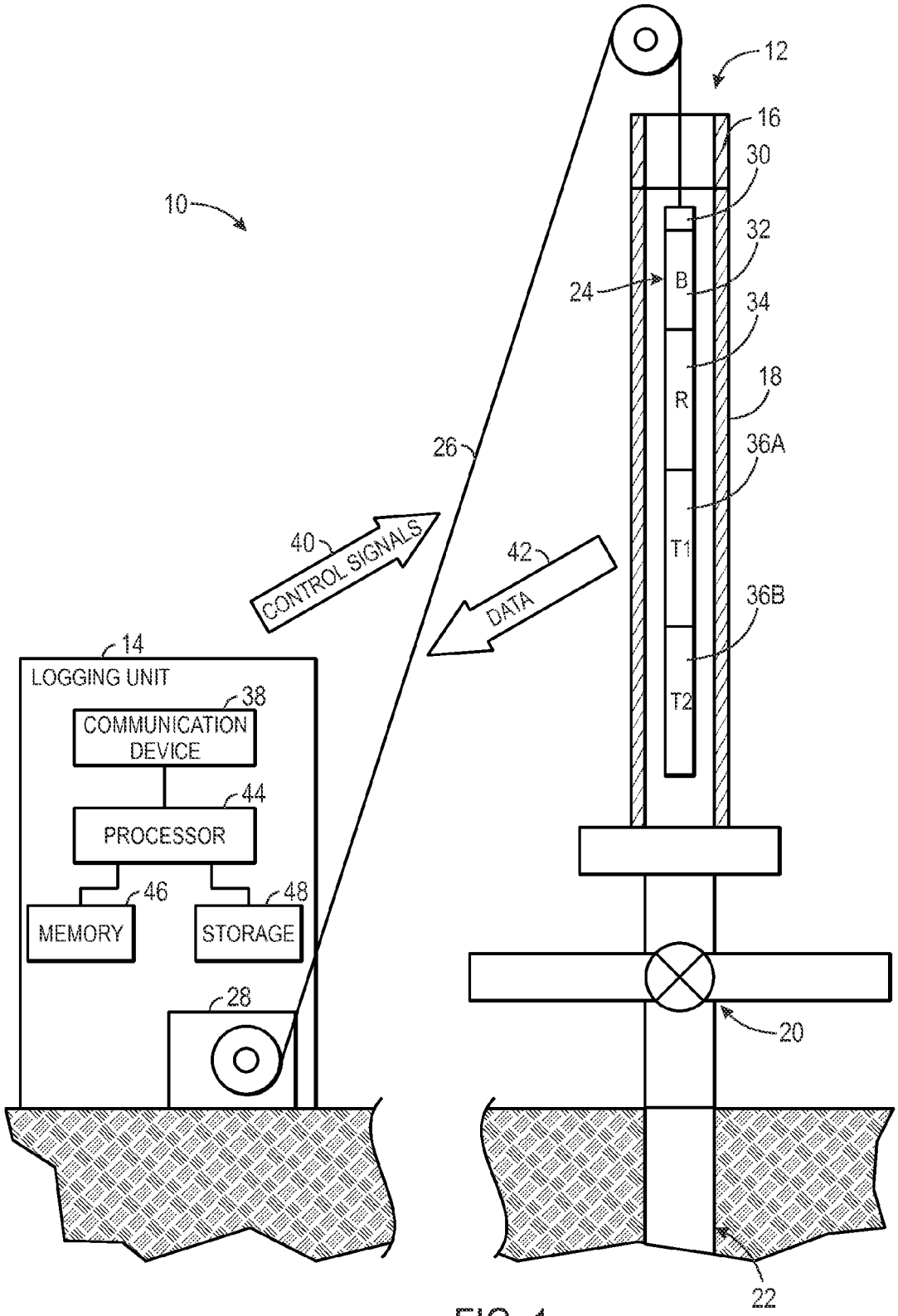
FIG. 1 is a schematic diagram of a well-logging system involving two-way wireless communication between a downhole tool string deployed in a pressure riser and a surface-based logging unit, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure describes two-way wireless communication between a downhole tool string and a surface-based logging unit. In certain examples discussed below, a logging unit may intercommunicate with a downhole tool string even while the downhole tools string is deployed in a conductive metal pressure riser. In one example, the downhole tool string may include a magnetic dipole antenna. The logging unit may include a similar magnetic dipole antenna. By communicating signals at sufficiently low frequencies (where the skin depth is relatively large), it is possible to transmit and receive signals through magnetic dipole coupling over suitable distances through the pressure riser. The magnetic dipole antennas may have magnetic cores to enhance magnetic dipole coupling through the pressure riser.

Additionally or alternatively, the downhole tool string and the logging unit may intercommunicate using electric dipole antennas, acoustic transducers, or optical communication devices. For instance, an acoustic transducer attached to the outer wall of the pressure riser may send and receive sound signals to an acoustic device in the downhole tool string. In another example, an optical communication device may send and receive light through a transparent window in the pressure riser to an optical communication device in the downhole tool string. A magnetic dipole antenna, electrical dipole antenna, an acoustic transducer, or an optical communication device may also be embedded in the pressure riser or a stuffing box above the pressure riser to communicate with the downhole tool string while the downhole tool string is within the pressure riser.

Two-way communication through the pressure riser provides greater control of the downhole tool string. For instance, a component of the downhole tool string (e.g., a battery sub or a nuclear downhole tool) may be in a deactivated or partially deactivated state while at the surface. The downhole tool string may be placed into the pressure riser while the component is deactivated. Once in the pressure riser, the logging unit may issue a command to cause the component to enter an activated state to permit well-logging. Additionally or alternatively, the logging unit may conduct an operational check of the downhole tool to ensure the downhole tool is operating correctly. The logging unit may request the status of the downhole tool, which may reply with some feedback signal that verifies the downhole tool is operative.

One example of a well-logging system 10 that can conduct two-way wireless communication appears in FIG. 1. In the example of FIG. 1, a well 12 is disposed near a logging unit 14. The well 12 may be pressurized, maintaining a substantially equal and opposite pressure during well-logging. For instance, as shown in FIG. 1, a stuffing box 16 and a pressure riser 18 may be disposed over a wellhead valve 20 (e.g., a blowout preventer (BOP)). It should be noted, however, that any suitable hardware implementation to seal well pressure in wireline operations may be used, and such hardware may include more elaborate hardware setups (e.g., grease injection equipment). Moreover, it should be appreciated that the example of FIG. 1 is a simplified diagram. In practice, as should be appreciated, the well 12 may include many valves and hardware other than the stuffing box 16, pressure riser 18, and/or wellhead valve 20. Thus, as used herein, the terms "stuffing box" and "pressure riser" refer generally to any suitable hardware implementation to seal well pressure in wireline operations.

In general, the pressure riser 18 may maintain pressure control over the well when an instrument is placed in the well 12. The stuffing box 16 serves as a cap on the pressure riser 18. The stuffing box 16, pressure riser 18, and wellhead valve 20 may be located underwater (e.g., in an offshore well 12) or on land (e.g., in an onshore well 12). The logging unit 14 may be understood to be "at the surface." As such, the logging unit 14 may be located, for example, on an offshore platform above the well 12 or on a truck near the well 12. A rock formation surrounds a wellbore 22 of the well 12. Different characteristics of the rock formation surrounding the wellbore 22 may indicate the likely presence or absence of hydrocarbons such as oil or gas. By logging the well 12, characteristics of the rock formation surrounding the wellbore 22 can be detected and valuable information about the well 12 may be determined.

A downhole tool string 24 may be used for such well-logging purposes. The downhole tool string 24 may be lowered through the stuffing box 16 and pressure riser 18 using any suitable means of conveyance, such as a slick line 26. Other suitable means of conveyance may include, for example, conveyance within a drill string or other jointed pipe string, on coiled tubing, or on armored electrical cable, to name a few examples. The slick line 26 may be a strong wire, sometimes referred to as a piano wire, that mechanically supports the downhole tool string 24. A motor 28 may raise or lower the downhole tool string 24, using the weight of the downhole tool string 24 to send it downhole in the same manner of other wireline tools. Because the slick line 26 may not provide power or telemetry, the downhole tool string 24 may not communicate over the slick line 26. Instead, the downhole tool string 24 may communicate with the logging unit 14 using two-way wireless communication. Various ways of such two-way wireless communication will be discussed in greater detail below.

The downhole tool string 24 may include several components. A rope socket 30 may join the slick line 26 to the other components of the downhole tool string 24. A battery sub (B) 32 may provide power for a recorder (R) 34 and, in the example of FIG. 1, two downhole tools (T1) 36A and (T2) 36B. The recorder (R) 34 may include data storage circuitry to collect and/or process well-logging data from the downhole tools (T1) 36A and/or (T2) 36B. The recorder (R) 34 also may be equipped with a master switch to turn battery power on and off to the downhole tools (T1) 36A and (T2) 36B. The downhole tools (T1) 36A and (T2) 36B may represent any suitable downhole well-logging tools, production logging tools, casing inspection tools and the like. The downhole tools (T1) 36A and (T2) 36B generally may collect measurements relating to the wellbore 22 at varying depths. In one example, the downhole tools (T1) 36A and (T2) 36B may obtain measurements relating to the surrounding rock formation. In other examples, the downhole tools (T1) 36A and (T2) 36B may obtain production logs, casing logs, cement bond logs, or any other suitable measurements.

In some cases, the downhole tools (T1) 36A and/or (T2) 36B may include electronic nuclear radiation generators, such as neutron generators or x-ray generators. By way of example, such an electronic neutron generator may be a model of the Minitron™ by Schlumberger Technology Corporation. A Minitron™ may produce pulses of neutrons through deuteron-deuteron (d-D) and/or deuteron-triton (d-T) reaction. By way of example, the emitted neutrons may have energies of around 2 MeV or 14 MeV. In other cases, the downhole tools (T1) 36A and/or (T2) 36B may include an electronic x-ray generator. Such an x-ray generator may be a high-voltage x-ray generator such as that disclosed in U.S. Pat. No. 7,564,948, "HIGH VOLTAGE X-RAY GENERATOR AND RELATED OIL WELL FORMATION ANALYSIS APPARATUS AND METHOD," which is assigned to Schlumberger Technology Corporation and incorporated by reference herein in its entirely. X-rays emitted by such an X-ray generator may have a maximum energy of greater than 250 keV.

Regardless of whether the downhole tools (T1) 36A and/or (T2) 36B employ such electronic nuclear radiation generators, the downhole tools (T1) 36A and/or (T2) 36B may remain at least partially deactivated while the downhole tool string 24 is being assembled at the well 12. As will be described further below, the downhole tools (T1) 36A and/or (T2) 36B may remain deactivated until the downhole tool string 24 has been lowered into the pressure riser 18. In addition, in a producing oilfield, the European ATEX directive often applies. In accordance with the ATEX directive, two electrically active pieces of equipment may not be connected in certain situations. Therefore, when the downhole tool string 24 is assembled at the surface, the battery sub (B) 32 may be off or may be controlled by the recorder (R) 34 not to supply power to certain components of the downhole tool string 24. The downhole tools (T1) 36A and (T2) 36B therefore may be off by default, since the battery sub may not be supplying power to all of the components of the downhole tool string 24.

In many situations, the battery sub (B) 32 and the recorder (R) 34 may be pre-assembled in an area where ATEX is not in effect. The recorder (R) 34 may control the battery sub (B) 32 such that power is turned off to the downhole tools (T1) 36A and (T2) 36B. Thus, when the downhole tool string 24 is assembled at the surface, the downhole tools (T1) 36A and (T2) 36B may be off by default. All connections made during the assembly of the downhole tool string 24 may not be electrically active. In this way, compliance with ATEX may be achieved.

Even though the downhole tool string 24 is not fully active upon assembly, the components of the downhole tool string 24 may be made active afterward. Namely, the logging unit 14 may cause the downhole tool string 24 to become activated once the downhole tool string 24 has been lowered into the pressure riser 18. A communication device 38 in the logging unit 14 may issue a control signal 40 to the downhole tool string 24. A corresponding communication device disposed within the downhole tool string 24 may receive the control signal 40. The control signal 40 may cause the battery sub (B) 32 to become activated, to cause the recorder (R) 34 to cause the battery sub (B) 32 to supply power to other components of the downhole tool string 24, and/or the downhole tools (T1) 36A and/or (T2) 36B to become activated. Additionally or alternatively, the control signal 40 may cause the downhole tool string 24 (e.g., the recorder (R) 34) to conduct an "operational check" to ensure the downhole tool string 24 is working properly. The downhole tool string 24 may reply with data 42. This data 42 could include a feedback signal indicating that the downhole tool string 24 is fully activated and ready to log the well 12. Based on such a data 42 signal, the logging unit 14 may begin to convey the downhole tool string 24 down into the wellbore 22 to log the well 12.

After the downhole tool string 24 has logged the well 12 and returned to the pressure riser 18, the logging unit 14 may issue other control signals 40. The control signals 40 issued after well-logging may instruct the downhole tool string 24 to provide well-logging data or may cause the downhole tool string 24 to become at least partially deactivated. In response, the data 42 may include the well-logging data and/or a feedback signal confirming that components of the downhole tool string 24 have been deactivated. The data 42 may indicate, for instance, that the downhole tools (T1) 36A and/or (T2) 36B are no longer emitting nuclear radiation.

It may be appreciated that the opaque, conductive metal pressure riser 18 may impede conventional wireless communication. As such, the control signals 40 and the data signals 42 may be transmitted beyond the conductive metal pressure riser 18 in a variety of ways. For example, the control signals 40 and data signals 42 may be transmitted by magnetic dipole coupling or electric dipole coupling through the pressure riser 18 (e.g., as discussed below with reference to FIGS. 2 and 5). Despite some attenuation, magnetic dipole coupling or electric dipole coupling may permit certain relatively low frequency signals to pass through the pressure riser 18. To bypass the attenuation of the pressure riser 18 altogether, a magnetic dipole antenna or an electric dipole antenna may be installed within the pressure riser 18 or the stuffing box 16 (e.g., as discussed below with reference to FIGS. 3, 4, 6, and 7). In other examples, the control signals 40 and data signals 42 may be transmitted at least in part using acoustic or optical signaling (e.g., as discussed below with reference to FIGS. 8 and 9).

The communication device 38 may be controlled by a processor 44 of the logging unit 14. The processor 44 may be operably coupled to memory 46 and/or storage 48 to carry out the techniques described herein. The processor 44 and/or other data processing circuitry may carry out instructions stored on any suitable article of manufacture with one or more tangible, computer-readable media at least collectively storing such instructions. The memory 46 and/or the nonvolatile storage 48 may represent such an article of manufacture. Among other things, the memory 46 and/or the nonvolatile storage 48 may represent random-access memory, read-only memory, rewriteable-memory, hard drive, or optical discs.

Figure 2:
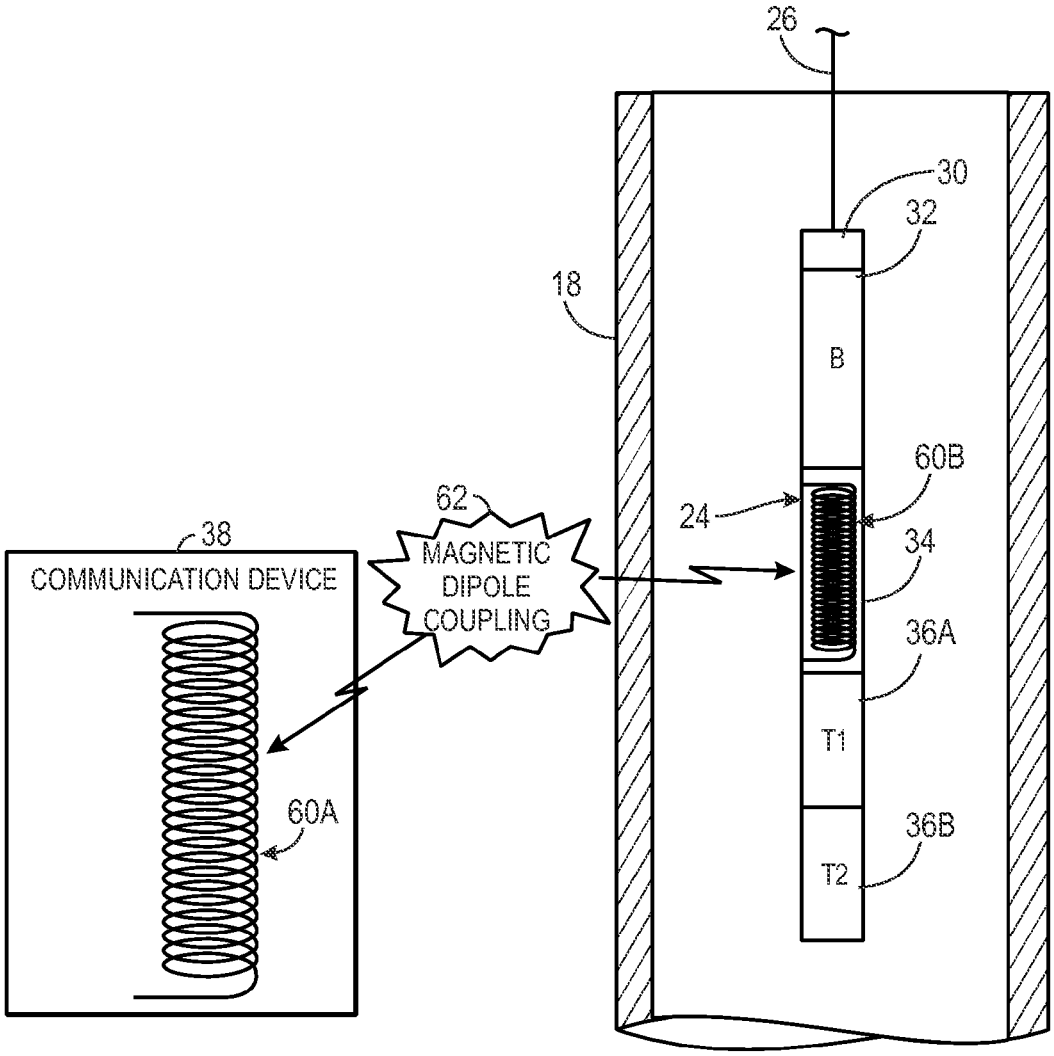
FIG. 2 is a schematic diagram of two-way communication between a magnetic dipole antenna at the logging unit and a magnetic dipole antenna in the downhole tool string, in accordance with an embodiment.

In one particular example shown in FIG. 2, the communication device 38 at the logging unit 14 may include a magnetic dipole antenna 60A. The downhole tool string 24 includes a corresponding magnetic dipole antenna 60B. In the example of FIG. 2, the downhole tool string 24 is suspended within the pressure riser 18 by the slick line 26 attached to the rope socket 30. The magnetic dipole antenna 60B is illustrated as being located within the recorder (R) 34 of the downhole tool string 24. It should be understood that the configuration of FIG. 2 is intended only as an example. Indeed, the magnetic dipole antenna 60B may be located in any other suitable component of the downhole tool string 24, including the battery sub (B) 32 or the downhole tools (T1) 36A and/or (T2) 36B. The downhole tool string 24 may also include additional magnetic dipole antennas 60 to enable communication with specific components of the downhole tool string 24.

The magnetic dipole antennas 60A and 60B may be identical or may be of different. For instance, the magnetic dipole antenna 60A located outside of the pressure riser 18 may have proportionally larger coils than the magnetic dipole antenna 60B. In any case, communication between the magnetic dipole antennas 60A and 60B may occur via magnetic dipole coupling 62. In the example of FIG. 2, the magnetic dipole coupling 62 travels through the conductive metal wall of the pressure riser 18. This causes the magnetic dipole coupling 62 signal to attenuate. At lower frequencies where the skin depth is large, however, it is possible to transmit and receive signals over suitable distances between the logging unit 14 and the well 12 (e.g., approximately 100 feet). To obtain communication reliability of approximately 99.9999998027%, the signal to noise ratio (SNR) may be selected to be greater than or equal to approximately 11.6 dB. One particular example of a magnetic dipole antenna 60 will be described in greater detail below with reference to FIGS. 10 and 11.

Figure 3:
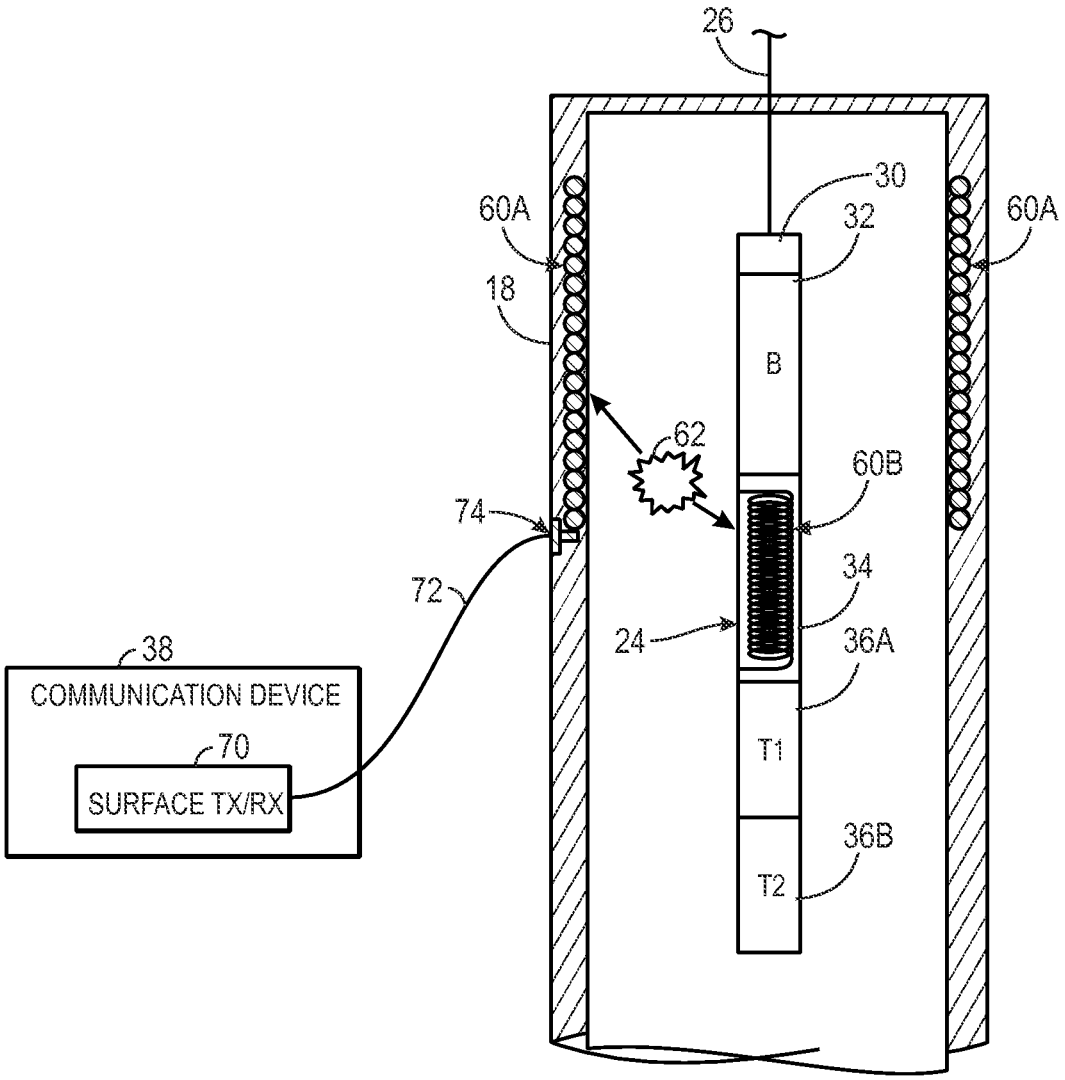
FIG. 3 is a schematic diagram of two-way communication between a magnetic dipole antenna embedded in the pressure riser and a magnetic dipole antenna in the downhole tool string, in accordance with an embodiment.

In another example, shown in FIG. 3, the magnetic dipole antenna 60B of the downhole tool string 24 may communicate with the communication device 38 via a magnetic dipole antenna 60A embedded in the pressure riser 18. In the example of FIG. 3, the downhole tool string 24 is suspended within the pressure riser 18 by the slick line 26 attached to the rope socket 30. The magnetic dipole antenna 60B is illustrated as being located within the recorder (R) 34 of the downhole tool string 24. It should be understood that the configuration of FIG. 3 is intended only as an example. Indeed, the magnetic dipole antenna 60B may be located in any other suitable component of the downhole tool string 24, including the battery sub (B) 32 or the downhole tools (T1) 36A and/or (T2) 36B. The downhole tool string 24 may also include additional magnetic dipole antennas 60 to enable communication with specific components of the downhole tool string 24.

The communication device 38 of the logging unit 14 may include wired surface transmit/receive (TX/RX) circuitry 70. The surface TX/RX circuitry 70 may provide signals over a communication cable 72. The communication cable 72 may couple to the magnetic dipole antenna 60A, which may be embedded within the pressure riser 18, using a pressure feed-through 74. The pressure feed-through 74 may allow electrical connections to components embedded within the pressure riser 18 without compromising the integrity of the pressure riser 18.

The magnetic dipole antenna 60A embedded in the pressure riser 18 may include any suitable size and number of windings around the interior diameter of the pressure riser 18. The magnetic dipole antenna 60A of the example of FIG. 3 may operate in substantially the same manner as the magnetic dipole antenna 60A of the example of FIG. 2. The strength of the magnetic dipole coupling 62 needed to convey the same signal may be significantly reduced, however, because the magnetic dipole coupling 62 need not travel through the conductive metal wall of the pressure riser 18.

Figure 4:
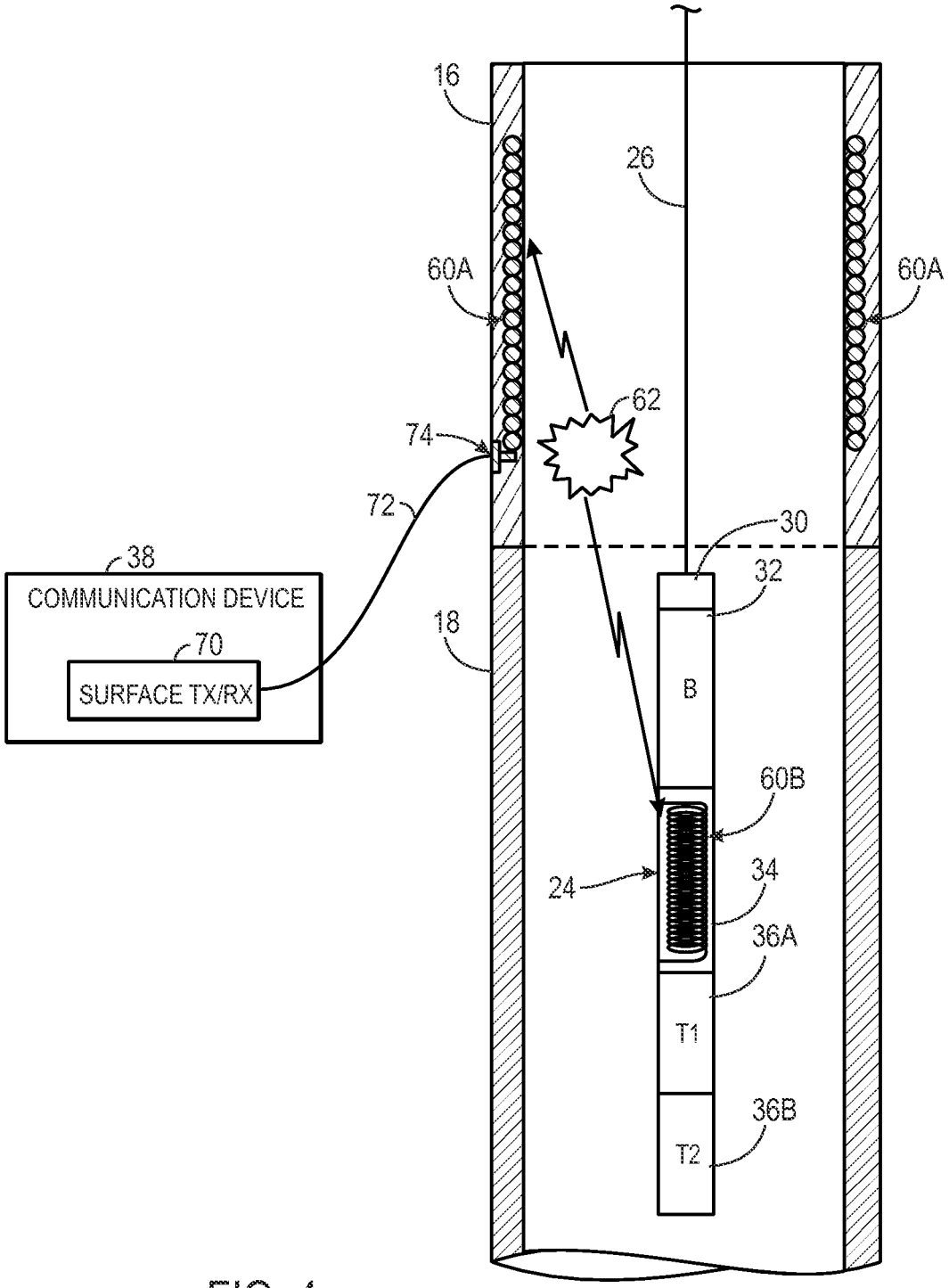
FIG. 4 is a schematic diagram of two-way communication between a magnetic dipole antenna embedded in a stuffing box adjacent to the pressure riser and a magnetic dipole antenna in the downhole tool string, in accordance with an embodiment.

The magnetic dipole antenna 60A may also be located within the stuffing box 16 adjacent to the pressure riser 18, as shown in FIG. 4. In the example of FIG. 4, as in those of FIGS. 2 and 3, the downhole tool string 24 is suspended within the pressure riser 18 by the slick line 26 attached to the rope socket 30. The magnetic dipole antenna 60B is illustrated as being located within the recorder (R) 34 of the downhole tool string 24. It should be understood that the configuration of FIG. 4 is intended only as an example. Indeed, the magnetic dipole antenna 60B may be located in any other suitable component of the downhole tool string 24, including the battery sub (B) 32 or the downhole tools (T1) 36A and/or (T2) 36B. The downhole tool string 24 may also include additional magnetic dipole antennas 60 to enable communication with specific components of the downhole tool string 24.

The communication device 38 of the logging unit 14 may include wired surface transmit/receive (TX/RX) circuitry 70 in substantially the same manner as described with reference to FIG. 3. The surface TX/RX circuitry 70 may provide signals over a communication cable 72. The communication cable 72 may couple to the magnetic dipole antenna 60A, which may be embedded within the stuffing box 16 associated with the pressure riser 18, using a pressure feed-through 74. The pressure feed-through 74 may allow electrical connections to components embedded within the stuffing box 16 without compromising the integrity of the stuffing box 16. It should be noted that, in the example of FIG. 4, the stuffing box 16 has been modified, but the pressure riser 18 may be substantially the same as conventional designs. Thus, the example of FIG. 4 may avoid modifying the main body of the pressure riser 18, which is a large and heavy piece of equipment.

Figure 5:
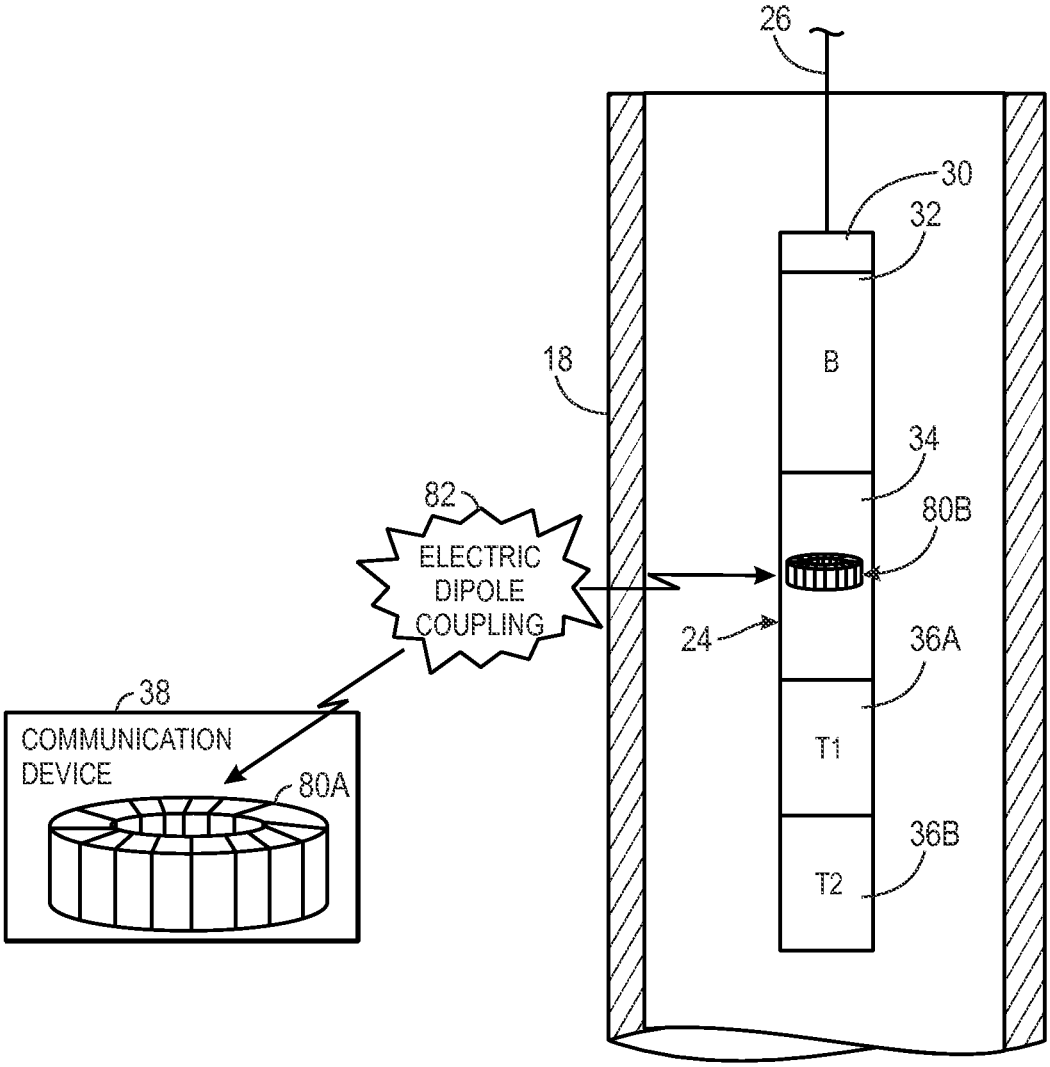
FIG. 5 is a schematic diagram of two-way communication between an electric dipole antenna at the logging unit and an electric dipole antenna in the downhole tool string, in accordance with an embodiment.
Figure 6:
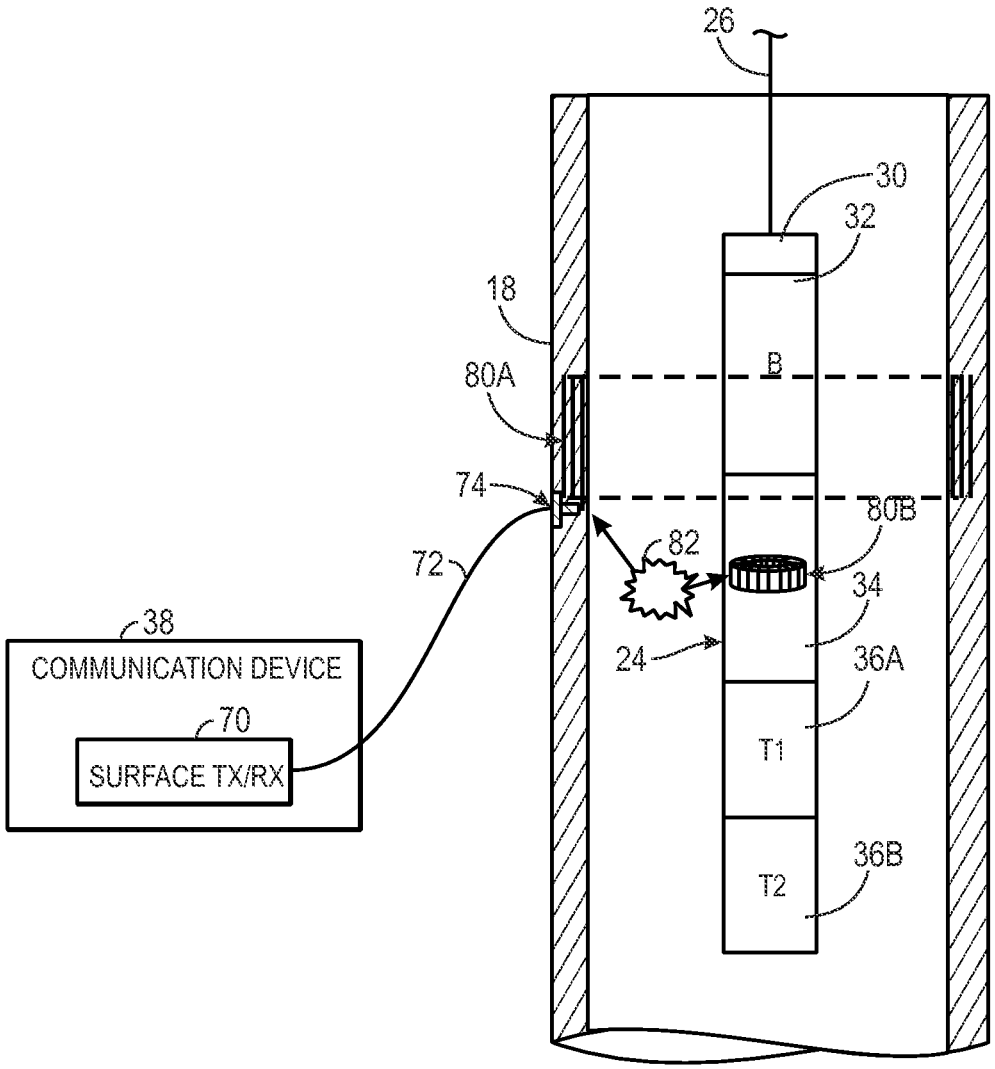
FIG. 6 is a schematic diagram of two-way communication between an electric dipole antenna embedded in the pressure riser and an electric dipole antenna in the downhole tool string, in accordance with an embodiment.
Figure 7:
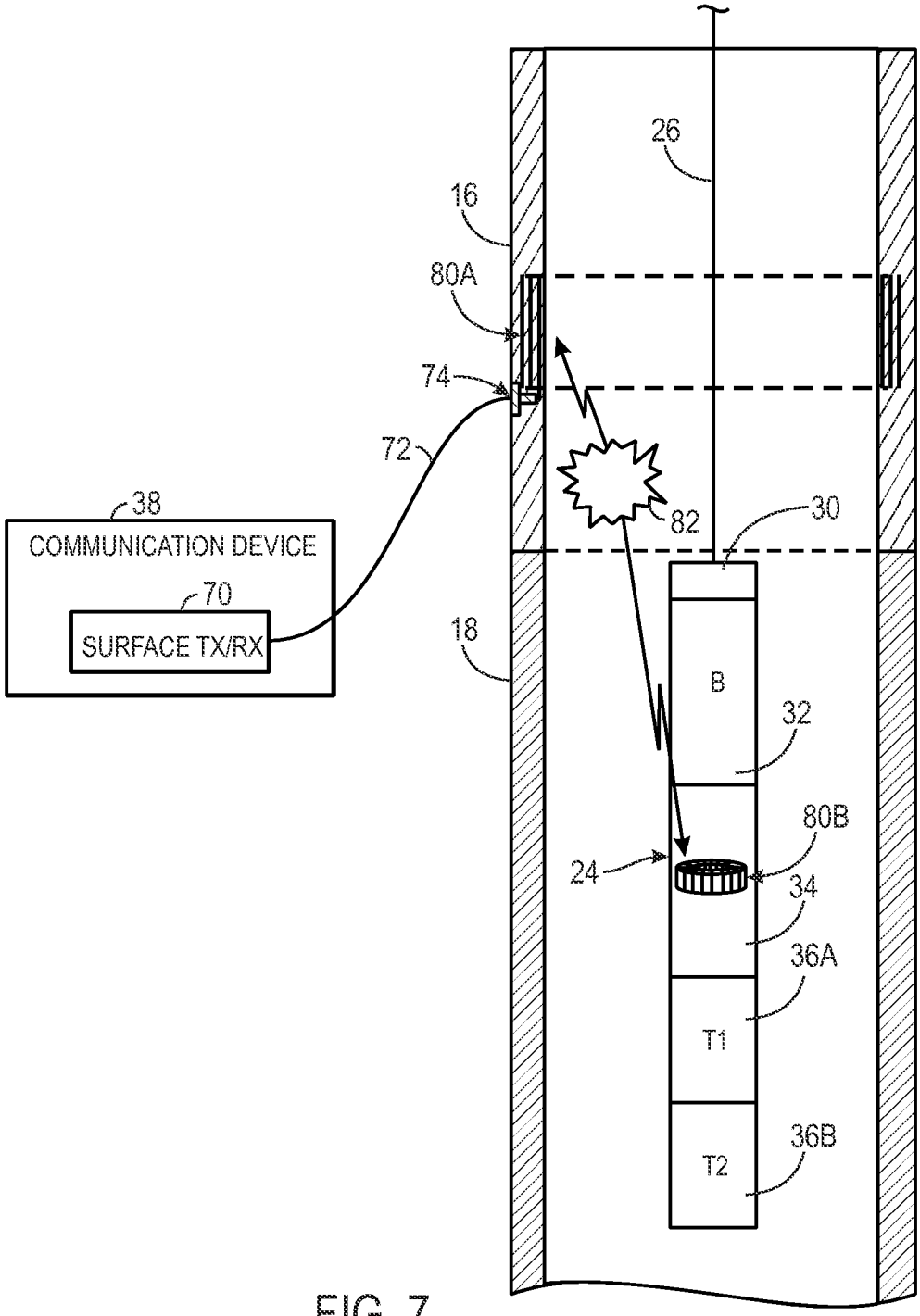
FIG. 7 is a schematic diagram of two-way communication between an electric dipole antenna embedded in the stuffing box adjacent to the pressure riser and an electric dipole antenna in the downhole tool string, in accordance with an embodiment.

In the examples of FIGS. 2-4, two-way wireless communication takes place via magnetic dipole coupling using magnetic dipole antennas 60A and 60B. Additionally or alternatively, as shown in FIGS. 5-7, two-way wireless communication takes place via electric dipole coupling using electric dipole antennas 80A and 80B. In FIG. 5, for instance, the communication device 38 at the logging unit 14 may include an electric dipole antenna 80A and the downhole tool string 24 may include a corresponding electric dipole antenna 80B. In the example of FIG. 5, the downhole tool string 24 is suspended within the pressure riser 18 by the slick line 26 attached to the rope socket 30. The electric dipole antenna 80B is illustrated as being located within the recorder (R) 34 of the downhole tool string 24. It should be understood that the configuration of FIG. 5 is intended only as an example. Indeed, the electric dipole antenna 80B may be located in any other suitable component of the downhole tool string 24, including the battery sub (B) 32 or the downhole tools (T1) 36A and/or (T2) 36B. The downhole tool string 24 may also include additional electric dipole antennas 80 to enable communication with specific components of the downhole tool string 24.

An electric dipole can be generated using a toroidal winding, as generally represented in electric dipole antennas 80A and 80B. To obtain a sufficient signal to noise ratio (SNR), a toroidal electric dipole antenna 80A located outside of the pressure riser 18 may be proportional to, but larger than, the toroidal electric dipole antenna 80B located in the downhole tool string 24. Specifically, as with the magnetic dipole examples of FIGS. 2-4, electric dipole coupling 82 will be attenuated by the conductive metallic wall of the pressure riser 18. Still, at lower frequencies where the skin depth is large, it is possible to transmit and receive signals over suitable distances between the logging unit 14 and the well 12.

Alternatively, the electric dipole antenna 80B may be embedded within the pressure riser 18 or the stuffing box 16. For example, as shown in FIG. 6, the electric dipole antenna 80B of the downhole tool string 24 may communicate with the communication device 38 via an electric dipole antenna 80A embedded in the pressure riser 18. In the example of FIG. 6, the downhole tool string 24 is suspended within the pressure riser 18 by the slick line 26 attached to the rope socket 30. The electric dipole antenna 80B is illustrated as being located within the recorder (R) 34 of the downhole tool string 24. It should be understood that the configuration of FIG. 5 is intended only as an example. Indeed, the electric dipole antenna 80B may be located in any other suitable component of the downhole tool string 24, including the battery sub (B) 32 or the downhole tools (T1) 36A and/or (T2) 36B. The downhole tool string 24 may also include additional electric dipole antennas 80 to enable communication with specific components of the downhole tool string 24.

The communication device 38 of the logging unit 14 may include the wired surface transmit/receive (TX/RX) circuitry 70. The surface TX/RX circuitry 70 may provide signals over a communication cable 72. The communication cable 72 may couple to the toroidal electric dipole antenna 80A, which may be embedded within the pressure riser 18, using a pressure feed-through 74. The pressure feed-through 74 may allow electrical connections to components embedded within the pressure riser 18 without compromising the integrity of the pressure riser 18.

The electric dipole antenna 80A embedded in the pressure riser 18 may include any suitable size and number of toroidal windings within the pressure riser 18. The electric dipole antenna 80A of the example of FIG. 6 may operate in substantially the same manner as the electric dipole antenna 80A of the example of FIG. 5. The strength of the electric dipole coupling 82 needed to convey the same signal may be significantly reduced, however, because the electric dipole coupling 82 need not travel through the conductive metal wall of the pressure riser 18.

In another example, the electric dipole antenna 80A may be located within the stuffing box 16 adjacent to the pressure riser 18, as shown in FIG. 7. In the example of FIG. 7, as in those of FIGS. 5 and 6, the downhole tool string 24 is suspended within the pressure riser 18 by the slick line 26 attached to the rope socket 30. The electric dipole antenna 80B is illustrated as being located within the recorder (R) 34 of the downhole tool string 24. It should be understood that the configuration of FIG. 7 is intended only as an example. Indeed, the electric dipole antenna 80B may be located in any other suitable component of the downhole tool string 24, including the battery sub (B) 32 or the downhole tools (T1) 36A and/or (T2) 36B. The downhole tool string 24 may also include additional electric dipole antennas 80 to enable communication with specific components of the downhole tool string 24.

The communication device 38 of the logging unit 14 may include wired surface transmit/receive (TX/RX) circuitry 70 in substantially the same manner as described above. The surface TX/RX circuitry 70 may provide signals over a communication cable 72. The communication cable 72 may couple to the electric dipole antenna 80A, which may be embedded within the stuffing box 16 associated with the pressure riser 18, using a pressure feed-through 74. The pressure feed-through 74 may allow electrical connections to components embedded within the stuffing box 16 without compromising the integrity of the stuffing box 16. It should be noted that, in the example of FIG. 7, the stuffing box 16 has been modified, but the pressure riser 18 may be substantially the same as conventional designs. Thus, the example of FIG. 7 may avoid modifying the main body of the pressure riser 18, which is a large and heavy piece of equipment.

Figure 8:
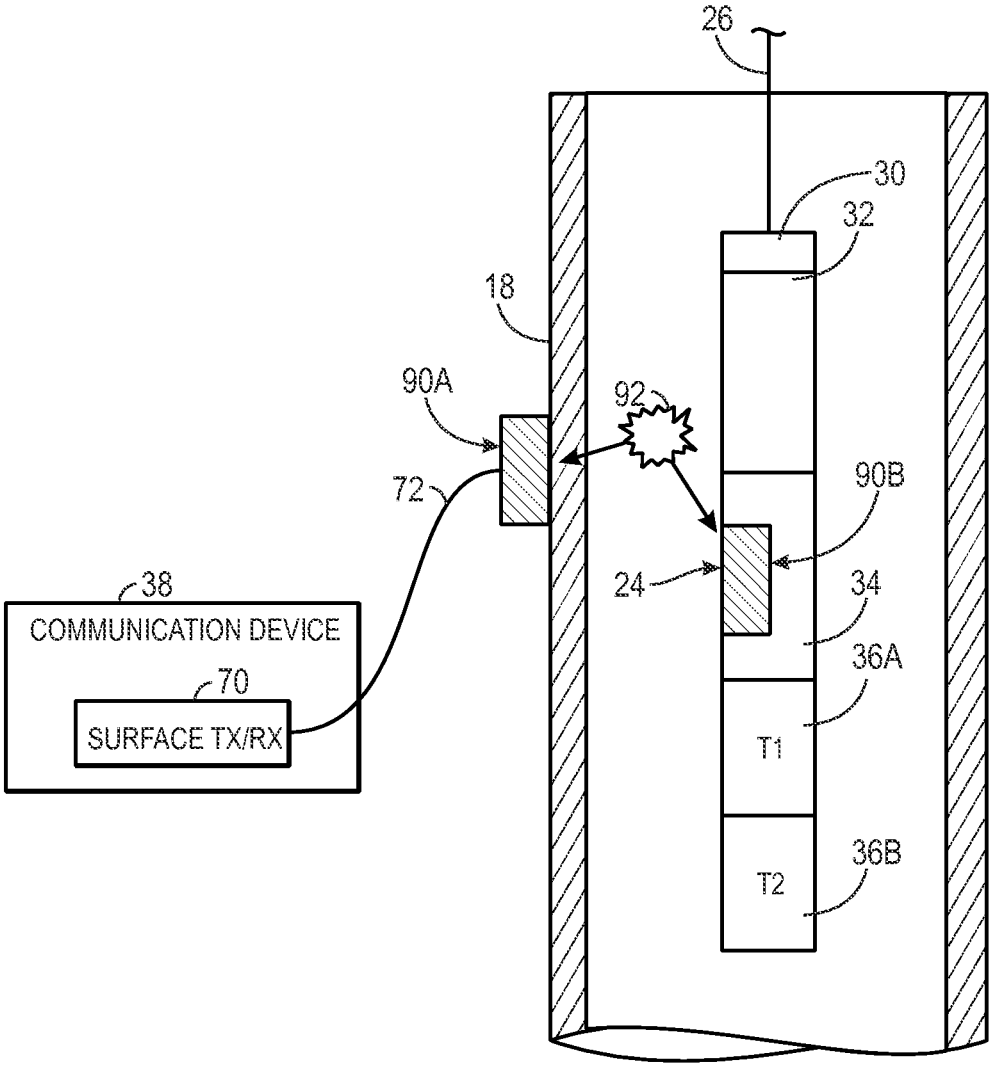
FIG. 8 is a schematic diagram of two-way communication between an acoustic transducer attached to the pressure riser and an acoustic transducer in the downhole tool string, in accordance with an embodiment.

Two-way communication with the downhole tool string 24 may also take place via acoustic and/or optical communication. For example, FIG. 8 illustrates acoustic communication between an acoustic transducer 90A attached to the outer wall of the pressure riser 18 and an acoustic transducer 90B located within the downhole tool string 24. In the example of FIG. 8, the downhole tool string 24 is suspended via the rope socket 30 on the slick line 26. The acoustic transducer 90B is illustrated as being located within the recorder (R) 34 of the downhole tool string 24 in FIG. 8, but it should be understood that this configuration is merely intended as an example. Indeed, the acoustic transducer 90B may be located in any other suitable component of the downhole tool string 24, including the battery sub (B) 32 or the downhole tools (T1) 36A and/or (T2) 36B. The downhole tool string 24 may also include additional acoustic transducers 90 to enable communication with specific components of the downhole tool string 24.

The acoustic transducers 90A and 90B facilitate communication through sound waves 92 passing between the conductive wall of the pressure riser 18 and the borehole fluid within the pressure riser 18. It should be appreciated that the sound waves 92 can pass through a solid, electrically conductive wall, albeit with some attenuation. Since the distance between the acoustic transducers 90A and 90B is relatively short, however, sufficient signal intensity may allow communication via the sound waves 92.

In the example of FIG. 8, the communication device 38, which may be located at the logging unit 14, may include a surface transmitter/receiver (TX-RX) 70 and a communication cable 72 coupled to the acoustic transducer 90A. Although the acoustic transducer 90A appears outside of the pressure riser 18 in FIG. 8, the acoustic transducer 90A may alternatively be manufactured into the pressure riser 18 and/or the stuffing box 16. Such alternative embodiments may be similar to the examples discussed above with reference to FIGS. 3, 4, 6, and 7. For such alternatives, a pressure feed-through 74 may allow the communication cable 72 to reach an embedded acoustic transducer 90.

Figure 9:
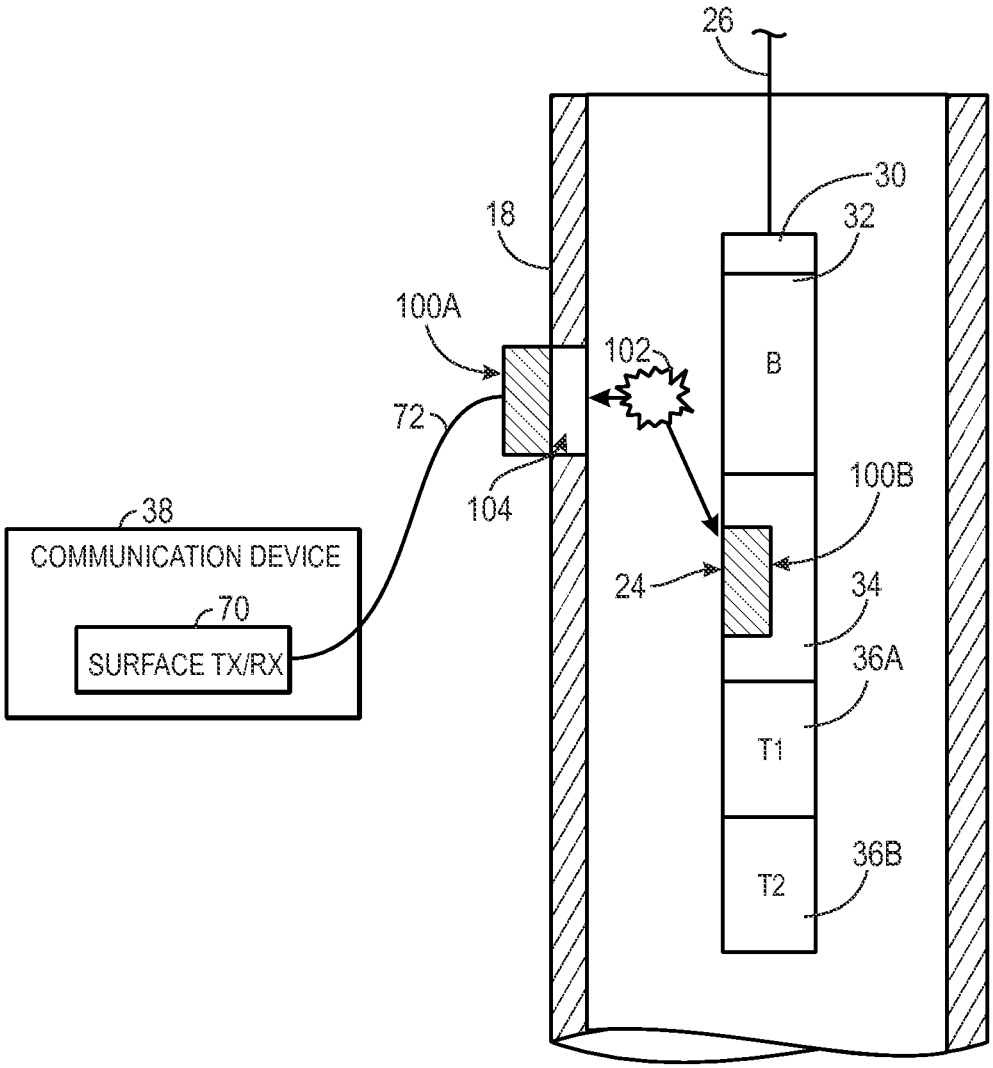
FIG. 9 is a schematic diagram of two-way communication between an optical communication device adjacent to a light-transmissive window in the pressure riser and an optical communication device in the downhole tool string, in accordance with an embodiment.

In another example, shown in FIG. 9, the communication device 38 at the logging unit 14 may communicate with the downhole tool string 24 using optical communication through the pressure riser 18. In the example of FIG. 9, the downhole tool string 24 is suspended in the pressure riser 18 by the slick line 26 attached to the rope socket 30. A first optical communication device 100A may be attached to the outer wall of the pressure riser 18. A corresponding optical communication device 100B is located in the downhole tool string 24. The optical communication devices 100A and 100B communicate via signals of light 102, which pass through the pressure riser 18 via an optically transmissive window 104. In the example of FIG. 9, the battery sub (B) 32 contains the optical communication device 100B. It should be understood, however, that the optical communication device 100B may be located within any suitable component of the downhole tool string 24 (e.g., the recorder (R) 34 or the downhole tools (T1) 36A and/or (T2) 36B). Moreover, in some examples, more than one component of the downhole tool string 24 may include an optical communication device 100.

The light 102 emitted and detected by the optical communication devices 100A and 100B may be of any suitable wavelength(s). For instance, the optical communication devices 100A and 100B may employ light emitting diodes (LEDs) of ultra violet (UV) to infrared (IR) wavelengths. The optical communication devices 100A and/or 100B may use lasers (e.g., LED lasers) to emit the light. Unlike the magnetic dipole coupling, electric dipole coupling, and acoustic communication approaches discussed above, optical transmission cannot pass through the opaque outer wall of the pressure riser 18 without the optically transmissive window 104. Alternatively, the optically transmissive window 104 may be avoided by placing the optical communication device 100A within or embedded in the pressure riser 18, and using a pressure feed-through 74 in the manner discussed above with reference to FIGS. 3, 4, 6 and 7. For such alternative embodiments, optical or electrical pressure feed-throughs 74 may be employed as desired.

Figure 10:
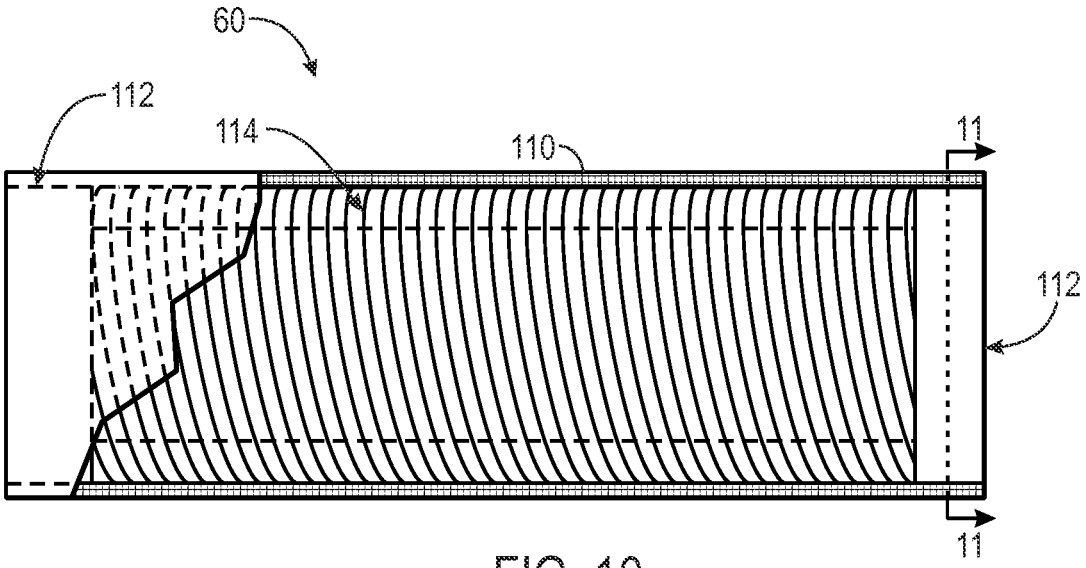
FIG. 10 is a schematic cut-away diagram of a magnetic dipole antenna having a magnetic core, in accordance with an embodiment.
Figure 11:
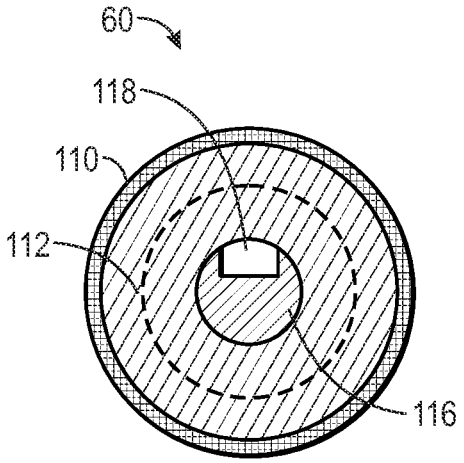
FIG. 11 is a cross-sectional view of the magnetic dipole antenna of FIG. 10, in accordance with an embodiment.

In several examples discussed above, magnetic dipole coupling provides two-way communication between the logging unit 14 and the downhole tool string 24 (e.g., FIGS. 2-4). FIGS. 10 and 11 provide one example of a magnetic dipole antenna 60 that may facilitate magnetic dipole coupling. In particular, FIG. 10 represents a schematic partial cut-away view of the magnetic dipole antenna 60 and FIG. 11 represents a cross-sectional schematic view of FIG. 10 at cut lines 11-11.

As seen in FIG. 10, the magnetic dipole antenna 60 may be generally cylindrical and housed in a nonconductive tube 110. The nonconductive tube 110 may be formed from any suitable nonconductive material, such as fiberglass. Visible when the nonconductive tube 110 has been partially cutaway is a nonconductive magnetic core 112. The nonconductive magnetic core 112 may extend to the inner diameter of the nonconductive tube 110 at the far ends of the magnetic dipole antenna 60. In a central portion of the magnetic dipole antenna 60, the nonconductive magnetic core 112 has a smaller diameter (as provided by hidden lines). One or more layers of windings 114 are wrapped around this central portion of the nonconductive magnetic core 112. It is believed that wrapping the windings 114 around the nonconductive magnetic core 112 may boost magnetic dipole coupling in the magnetic dipole antenna 60. Any suitable number of layers and turns of the windings 114 may be employed. For instance the magnetic dipole antenna 60 may include 1, 2, 3, 4, 5, 6, 7, 8, 9, 10, or more, layers. Likewise, the windings 114 may include any suitable number of turns based on the size of the windings 114 and the length and diameter of the magnetic dipole antenna 60, and may include 100, 200, 500, 1000, 2000, 2500, 3000, 3500, 5000, 7500, 10,000, or more, turns. As should be appreciated, the number of turns and layers of the windings 114 may vary depending on individual design constraints.

The cross-sectional view of FIG. 11 derives from cut lines 11-11 of FIG. 10. As can be seen in FIG. 11, the outer nonconductive tube 110 surrounds the nonconductive magnetic core 112. The location of the windings 114 are not visible in FIG. 11, as the windings 114 are located behind the cross-sectional view shown in FIG. 11 (beginning at the outer diameter of the hidden lines). The nonconductive magnetic core 112 may be disposed around a metal rod 116. A notch 118 in the metal rod 116 may or may not be present and may facilitate the construction and/or alignment of the magnetic dipole antenna 60. It should be understood that FIGS. 10 and 11 are merely intended to schematically represent one example of the magnetic dipole antenna 60. In other words, while FIGS. 10 and 11 generally represent the components of the magnetic dipole antenna 60, actual implementations may vary occurring to specific design constraints.

Figure 12:
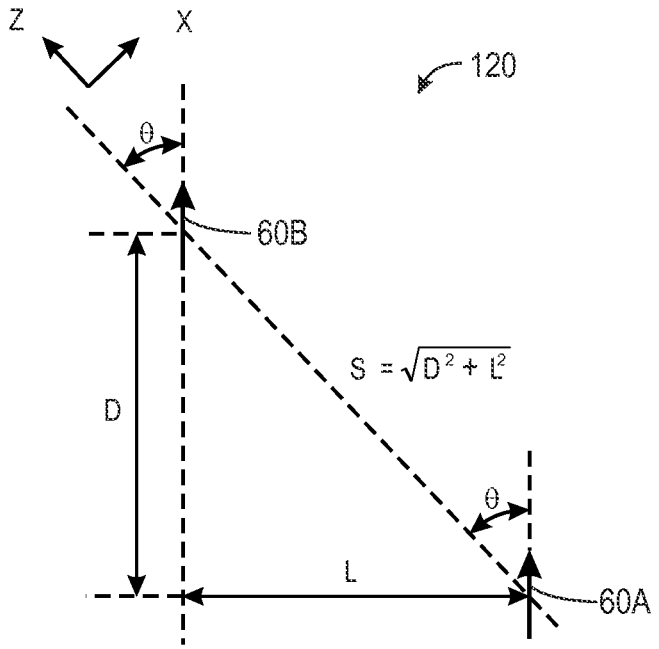
FIG. 12 is a vector diagram representing communication between two magnetic dipole antennas, in accordance with an embodiment.

Considering the case of magnetic dipole coupling in particular, two magnetic dipole antennas 60 can communicate in the manner shown in FIG. 12. In particular, a vector diagram 120 of FIG. 12 generally illustrates magnetic dipole coupling between two magnetic dipole antennas 60A and 60B in the X-Z plane.

To begin, the RX-TX induction coupling tensor between two points in space can be expressed as the following matrix:

$$C_{RT} = \begin{bmatrix} xx & xy & xz \\ yx & yy & yz \\ zx & zy & zz \end{bmatrix}, \tag{1}$$

where (zx) denotes the coupling when the magnetic dipole antenna 60B aligns with the Z-axis and the magnetic dipole antenna 60A aligns with the X-axis.

A received signal $V_R$ can be expressed as a product of matrices as shown below:

$$V_R = U_R^T C_{RT} U_T = I_T A_T A_R [\sin\theta \quad 0 \quad \cos\theta] \begin{bmatrix} xx & xy & xz \\ yx & yy & yz \\ zx & zy & zz \end{bmatrix} \begin{bmatrix} \sin\theta \\ 0 \\ \cos\theta \end{bmatrix}, \tag{2}$$

where $A_T$ is the transmitter effective area of the magnetic dipole antenna 60A, $A_R$ is the receiver effective area of the magnetic dipole antenna 60B, and $I_T$ is the transmitter current of the magnetic dipole antenna 60A.

In an infinite homogeneous formation, the coupling matrix can be written as:

$$zz = \frac{i\omega\mu e^{ikS}}{2\pi S^3}(1 - ikS); \tag{3}$$

$$xx = yy = \frac{i\omega\mu e^{ikS}}{4\pi S^3}(-1 + ikS + k^2S^2); \tag{4}$$

$$xy = yx = xz = zx = yz = zy = 0; \tag{5}$$

and $$C_{RT} = \begin{bmatrix} xx & 0 & 0 \\ 0 & yy & 0 \\ 0 & 0 & zz \end{bmatrix} = \frac{i\omega\mu e^{ikS}}{4\pi S^3} \begin{bmatrix} (-1 + ikS + k^2S^2) & 0 & 0 \\ 0 & (-1 + ikS + k^2S^2) & 0 \\ 0 & 0 & 2(1 - ikS) \end{bmatrix}; \tag{6}$$

where μ is the permeability (H/m), $$k = \sqrt{i\sigma\mu\omega} = \frac{1+i}{h}$$

is the propagation factor (1/m), $$h = \sqrt{\frac{2}{\sigma\mu\omega}}$$

is the skin depth (m), and σ is the formation conductivity (S/m). In air, $\mu=\mu_0=4\pi\times10^{-7}$ H/m. The σ of air ranges from 3 to 8×10-15 (S/m).

In air, term kS and $k^2S^2$ are small. By ignoring them, the coupling matrix in air can be simplified as the following:

$$\overline{C}_{RT} = \frac{i\omega\mu e^{ikS}}{4\pi S^3} \begin{bmatrix} -1 & 0 & 0 \\ 0 & -1 & 0 \\ 0 & 0 & 2 \end{bmatrix}. \tag{7}$$

Therefore, in air, the received signal $V_R$ can be written as follows:

$$V_R = I_T A_T A_R \frac{i\omega\mu e^{ikS}}{4\pi S^3}(2 - 3\sin^2\theta) = I_T A_T A_R \frac{i\omega\mu e^{ik\sqrt{D^2+L^2}}}{4\pi(D^2+L^2)^{\frac{3}{2}}}\left(2 - 3\frac{L^2}{D^2+L^2}\right). \tag{8}$$

When the downhole tool string 24 is pressure deployed, the downhole tool string 24 may be within the pressure riser 18 at certain points. Thus, either the transmitter or receiver magnetic dipole antenna 60A or 60B may be inside a steel pipe. The received magnetic dipole coupling 62 signal thus will be attenuated by the steel pipe. This attenuation is related to the skin depth of the metal pressure riser at the nominal frequency. The following equation illustrates the received signal attenuation:

$$r = e^{\frac{w}{h_s}}, \tag{9}$$

where w is the wall thickness of the steel of the pressure riser 18 (m), $$h_s = \sqrt{\frac{2}{\sigma_s\mu_s\omega}}$$

is the skin depth (m), $\mu_s$ is the steel pipe permeability of the pressure riser 18 (H/m), and $\sigma_s$ is the steel pipe conductivity of the pressure riser 18 (S/m). In air, $\mu_s=\mu_0=4\pi\times10^{-7}$ H/m. The $\sigma_s$ of steel is typically about 1.6×106 (S/m).

Choosing w=0.5" and $\mu_s=200\mu_0$, the signal attenuation at 25 Hz is about 19.6 dB. The received signal thus could be calculated as:

$$V_R = \frac{1}{r}U_R^T C_{RT} U_T = \frac{1}{r} I_T A_T A_R [\sin\theta \quad 0 \quad \cos\theta] \begin{bmatrix} xx & xy & xz \\ yx & yy & yz \\ zx & zy & zz \end{bmatrix} \begin{bmatrix} \sin\theta \\ 0 \\ \cos\theta \end{bmatrix}; \tag{10}$$

or $$V_R = \frac{1}{r} I_T A_T A_R \frac{i\omega\mu e^{ikS}}{4\pi S^3}(2 - 3\sin^2\theta) = \frac{1}{r} I_T A_T A_R \frac{i\omega\mu e^{ik\sqrt{D^2+L^2}}}{4\pi(D^2+L^2)^{\frac{3}{2}}}\left(2 - 3\frac{L^2}{D^2+L^2}\right). \tag{11}$$

Figure 13:
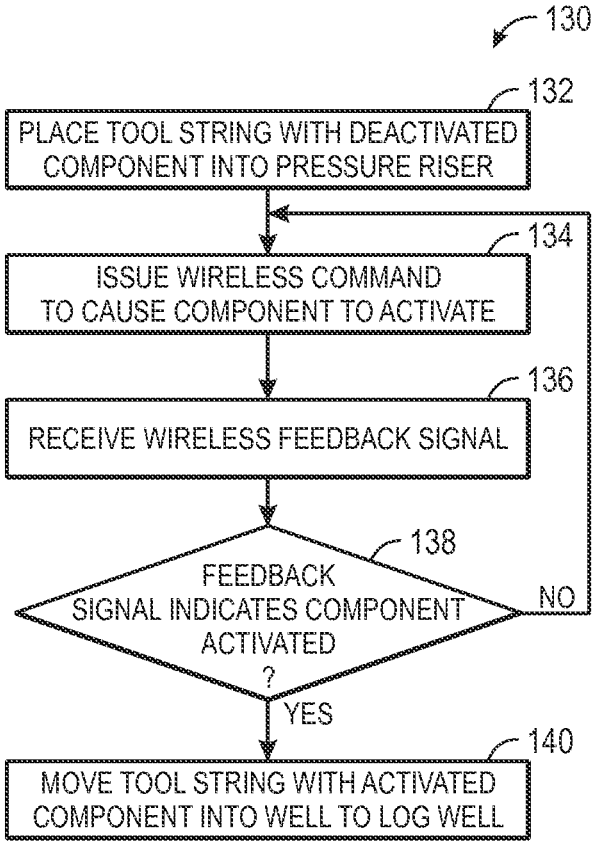
FIGS. 13 and 14 are flowcharts describing methods for activating and deactivating components of the downhole tool string while the downhole tool string is in the pressure riser, in accordance with embodiments.

Regardless of whether magnetic dipole coupling, electric dipole coupling, acoustic communication, or optical communication is used, two-way communication through the pressure riser 18 may allow for improved operation of the downhole tool string 24 when deployed under pressure. In a flowchart 130 of FIG. 13, for example, at least one component of the downhole tool string 24 may be verifiably activated while in the pressure riser 18. The flowchart 130 may begin when the downhole tool string 24 is lowered through the stuffing box 16 into the pressure riser 18 of the well 12 (block 132).

When the downhole tool string 24 is placed into the pressure riser 18, at least one component of the downhole tool string 24 may not be active. For example, under the European ATEX directive, it may not be possible to connect certain electrically active components. When operating under the ATEX directive, the downhole tool string 24 may be assembled while the battery sub (B) 32 is not supplying power to the other components of the downhole tool string 24. As such, in some cases, the recorder (R) 34 and the downhole tools (T1) 36A and/or (T2) 36B may not be active when the downhole tool string 24 is placed into the pressure riser 18 of the well. In other cases, the recorder (R) 34 and the battery sub (B) 32 may be assembled off-site where ATEX does not apply. Other components of the downhole tool string 24 (e.g., the downhole tools (T1) 36A and/or (T2)) may be coupled to the recorder (R) 34 and/or battery sub (B) 32 while the recorder (R) 34 is controlling the battery sub (B) 32 not to supply power to the other components. In another example, regardless of whether the European ATEX directive applies in a given setting, an electronic nuclear radiation generator in the downhole tools (T1) 36A and/or (T2) 36B may be deactivated while at the surface.

The downhole tool string 24 may not be able to log the well 12 until the various components of the downhole tool string 24 become activated. Furthermore, in the case whether the downhole tool (T1) 36A and/or (T2) 36B are nuclear downhole tools with electronic nuclear radiation generators, the downhole tools (T1) 36A and/or (T2) 36B may not be able to log a well until the nuclear radiation generator(s) are activated and begin to emit nuclear radiation, or alternatively, the radiation generator(s) are armed for downhole activation using various interlock methods (such as described in U.S. Pat. No. 6,649,906, "Method and apparatus for safely operating radiation generators in while-drilling and while-tripping applications," which is assigned to Schlumberger Technology Corp. and incorporated by reference herein in its entirety) that prevent generation of radiation at the surface. Once the downhole tool string 24 has been placed in the pressure riser 18, the logging unit 14 may take steps to activate the downhole tool string 24 and verify it is operative before logging the well 12 in earnest.

In particular, the logging unit 14 may issue a control signal 40 to the downhole tool string through the pressure riser 18 (block 134). The control signal 40 may reach the downhole tool string 24 via magnetic dipole coupling, electric dipole coupling, acoustic communication, and/or optical communication in the manners described above. Upon receipt of the control signal 40, the downhole tool string 24 may cause the deactivated component(s) of the downhole tool string 24 to become activated. In one example, the recorder (R) 34 may control the downhole tool string 24 such that power is provided to the other components of the downhole tool string 24. In another example, a deactivated battery sub (B) 32 may begin supplying power to the recorder (R) 34 and downhole tools (T1) 36A and/or (T2) 36B. In other examples, the downhole tools (T1) 36A and/or (T2) 36B may begin to emit nuclear radiation, or alternatively, the radiation generator may be armed for downhole activation using various interlock methods, such as those mentioned above, that prevent generation of radiation at the surface.

The downhole tool string 24 may reply with a wireless feedback data 42 signal (block 136). When the feedback data 42 signal indicates the previously deactivated component of the downhole tool string 24 has been activated (decision block 138) the logging unit 14 may lower the downhole tool string 24 into the wellbore 22 of the well 12 to log the well 12 (block 140). Otherwise, if the feedback data 42 signal does not indicate that the previously deactivated component of the downhole tool string 24 has become activated (decision block 138), the logging unit 14 may continue to issue the wireless command to activate the component (block 134). Without such an "operational check" of the downhole tool string 24, an operator of the logging unit 14 may choose not to expend the resources to attempt to log the well 12 until confirmation has been received that the downhole tool string 24 will be able to do so.

Figure 14:
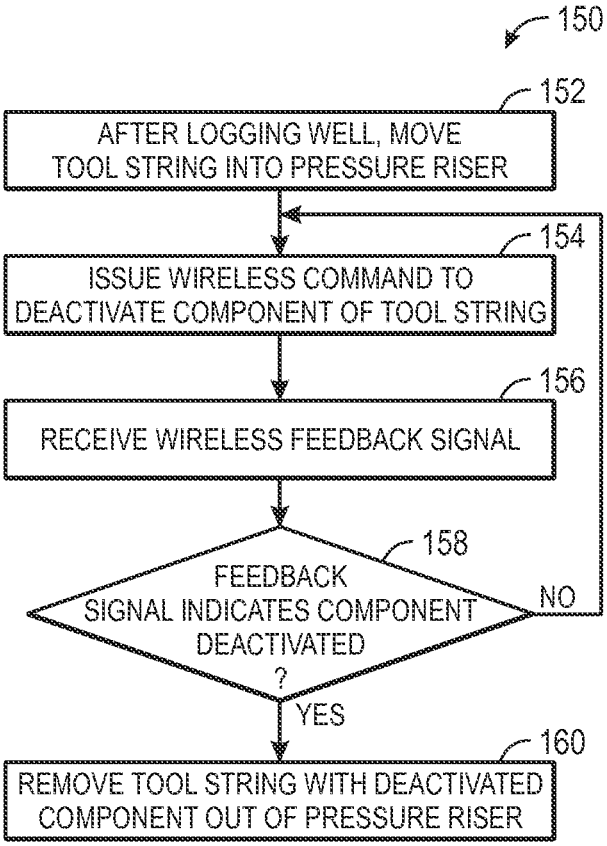

Two-way wireless communication may also allow at least one component of the downhole tool string 24 to be verifiably deactivated while in the pressure riser 18. For example, in a flowchart 150 of FIG. 14, the downhole tool string 24 may be raised out of the wellbore 22 and into the pressure riser 18 after logging the well 12 (block 152). When the downhole tool string 24 is raised into the pressure riser 18, at least one component of the downhole tool string 24 may be active. For example, an electronic nuclear radiation generator in the downhole tools (T1) 36A and/or (T2) 36B may be actively emitting radiation. Moreover, the battery sub (B) 32 may be supplying power to the various other components of the downhole tool string 24.

As mentioned above, under the European ATEX directive, it may not be possible to connect or disconnect certain electrically active components. When operating under the ATEX directive, the downhole tool string 24 may be disassembled while the battery sub (B) 32 is not supplying power to the other components of the downhole tool string 24. As such, in some embodiments, the recorder (R) 34 may cause power not to be provided to the various components that are to be disassembled at the surface (e.g., the recorder (R) 34 and the battery sub (B) 32 may remain connected at the surface and disassembled off-site, so the recorder (R) 34 may remain powered). In other embodiments, the battery sub (B) 32 of the downhole tool string 24 may be deactivated or may stop providing power to the other components of the downhole tool string 24 before reaching the surface. Likewise, any electronic nuclear radiation generators in the downhole tools (T1) 36A and/or (T2) 36B may be deactivated so as not to be emitting radiation when the downhole tool string 24 is raised out of the pressure riser 18.

Specifically, the logging unit 14 may issue a control signal 40 to the downhole tool string through the pressure riser 18 (block 154). The control signal 40 may reach the downhole tool string 24 via magnetic dipole coupling, electric dipole coupling, acoustic communication, and/or optical communication in the manners described above. Upon receipt of the control signal 40, the downhole tool string 24 may cause certain active components of the downhole tool string 24 to become deactivated. In one example, an active battery sub (B) 32 may stop supplying power to the recorder (R) 34 and downhole tools (T1) 36A and/or (T2) 36B. In another example, the downhole tools (T1) 36A and/or (T2) 36B may stop emitting nuclear radiation.

The downhole tool string 24 may reply with a wireless feedback data 42 signal (block 156). When the feedback data 42 signal indicates the previously activated component of the downhole tool string 24 has been deactivated (decision block 158), the logging unit 14 may remove the downhole tool string 24 out of the pressure riser 18 to the surface (block 160). Otherwise, if the feedback data 42 signal does not indicate that the previously activated component of the downhole tool string 24 has become deactivated (decision block 158), the logging unit 14 may return to reissue the wireless command to deactivate the component (block 154). Without such a "confirmation signal" of the downhole tool string 24, an operator of the logging unit 14 may choose not to raise the downhole tool string 24 out of the well 12 until confirmation has been received that the downhole tool string 24 is off and/or not emitting radiation.

Technical effects of the present disclosure include, among other things, the ability to perform an "operational check" on a downhole tool string even while the downhole tool string is in a pressure riser. Thus, through magnetic dipole coupling, electrical dipole coupling, acoustic communication, or optical communication, a logging unit may control a downhole tool string while the downhole tool string is in a pressure riser. In addition, the downhole tool string may be assembled in accordance with the European ATEX directive in an at least partially deactivated state at the surface. When the assembled, but deactivated, downhole tool string has been lowered into a pressure riser, the downhole tool string may be verifiably activated. Likewise, when the active downhole tool string is raised into the pressure riser after logging the well, the downhole tool string may be verifiably deactivated before being raised out to the surface.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method comprising:

placing a downhole tool string into a pressure riser of a well while at least one component of the downhole tool string is not activated; and issuing a wireless control signal through the pressure riser to the downhole tool to cause the downhole tool string to activate the at least one component;

wherein the wireless control signal is issued through the pressure riser via magnetic dipole coupling and wherein the wireless control signal comprises a signal-to-noise ratio of greater than or equal to 11.6 dB.

2. The method of claim 1, wherein the at least one component of the downhole tool string comprises a well-logging tool, and wherein issuing the wireless control signal causes the well-logging tool to begin or prepare to begin to gather well-logging data.

3. The method of claim 1, wherein the at least one component of the downhole tool string comprises an electronic nuclear radiation generator, and wherein issuing the wireless control signal causes the nuclear radiation generator to begin or to prepare to begin to generate radiation.

4. The method of claim 1, comprising receiving a wireless feedback signal from the downhole tool string while the downhole tool string is in the pressure riser, wherein the wireless feedback signal indicates the at least one component of the downhole tool string has been activated.

5. The method of claim 4, comprising lowering the downhole tool string from the pressure riser into a wellbore of the well to log at least a portion of the well when the wireless feedback signal indicates the at least one component of the downhole tool string has been activated.

6. A system comprising:

a downhole tool string comprising a first wireless communication device, wherein the downhole tool string is configured to be conveyed through a stuffing box into a pressure riser of a well; and a logging unit comprising a communication link to a second wireless communication device disposed on or embedded in, or both disposed on and embedded in the stuffing box or the pressure riser, or both the stuffing box and the pressure riser, the logging unit being configured to convey the downhole tool string through the stuffing box into the pressure riser of the well;

wherein the logging unit and the downhole tool string are configured to intercommunicate while the downhole tool string is located in the pressure riser via the first wireless communication device and the second wireless communication device.

7. The system of claim 6, wherein the first wireless communication device and the second wireless communication device each comprise a magnetic dipole antenna, an electric dipole antenna, an acoustic transducer, or an optical communication device, or any combination thereof.

8. The system of claim 6, wherein the downhole tool is configured to be conveyed using a noncommunicative slick line, such that the only communication between the downhole tool string and the logging unit while the downhole tool is in the pressure riser occurs via the first wireless communication device and the second wireless communication device.

9. The system of claim 6, wherein the logging unit is configured to issue a command to the downhole tool string from the first wireless communication device to the second wireless communication device to cause at least a component of the downhole tool string to become activated.

10. The system of claim 9, wherein the component of the downhole tool string comprises a battery sub configured to become activated based at least in part upon the command.

11. The system of claim 9, wherein the component of the downhole tool string comprises a nuclear radiation generator configured to become activated based at least in part upon the command.

12. The system of claim 9, wherein the logging unit is configured to issue a reply to the command from the second wireless communication device to the first wireless communication device.

13. A method comprising:

raising a downhole tool string out of a borehole of a well and into a pressure riser of the well, wherein the downhole tool string comprises a downhole tool in a first operational state; and issuing a wireless control signal to the downhole tool string while the downhole tool string is within the pressure riser to cause the downhole tool to exit the first operational state and enter a second operational state.

14. The method of claim 13, wherein the downhole tool emits nuclear radiation while in the first operational state and wherein the downhole tool substantially does not emit nuclear radiation while in the second operational state.

15. The method of claim 13, wherein the downhole tool gathers well-logging data while in the first operational state and wherein the downhole tool substantially does not gather well-logging data while in the second operational state.

16. The method of claim 13, comprising receiving a wireless feedback signal from the downhole tool string while the downhole tool string is in the pressure riser, wherein the wireless feedback signal indicates the downhole tool has exited the first operational state and entered the second operational state.

17. The method of claim 16, comprising raising the downhole tool string out of the pressure riser when the wireless feedback signal indicates the downhole tool has exited the first operational state and entered the second operational state.

18. A method comprising:

assembling a plurality of components of a downhole tool string together at a well site to obtain a downhole tool string, wherein the plurality of components of the downhole tool string are assembled without electrically active interconnections in compliance with ATEX regulations; and after the plurality of components of the downhole tool string are assembled together and placed within well-pressure-sealing hardware of a well, causing the interconnections to become electrically active using two-way communication, wherein the two-way control signal comprises a wireless control signal, wherein the wireless control signal is issued through the well-pressure-sealing hardware of the well via magnetic dipole coupling and wherein the wireless control signal comprises a signal-to-noise ratio of greater than or equal to 11.6 dB.

* * * * *